United States Patent [19]

Dilworth et al.

[11] Patent Number: 4,573,636

[45] Date of Patent: Mar. 4, 1986

[54] METHOD AND APPARATUS FOR MAKING ARTIFICIAL SNOW

[75] Inventors: James L. Dilworth, Petoskey; Robert J. Brinks, Alanson, both of Mich.

[73] Assignee: Nubs Nob, Inc., Harbor Springs, Mich.

[21] Appl. No.: 605,621

[22] Filed: Apr. 30, 1984

Related U.S. Application Data

[63] Continuation-in-part of Ser. No. 473,071, Apr. 18, 1983, Pat. No. 4,493,457.

[51] Int. Cl.[4] ..... A01G 15/00

[52] U.S. Cl. ..... 239/2 S; 239/14; 239/294

[58] Field of Search ..... 239/2 S, 14, 77, 294

[56] References Cited

U.S. PATENT DOCUMENTS

| | | | |
|---|---|---|---|
| 3,301,485 | 1/1967 | Tropeano et al. | 239/14 |
| 3,567,117 | 3/1971 | Eustis | 239/2 S |
| 3,703,991 | 11/1972 | Eustis et al. | 239/2 S |
| 3,733,029 | 5/1973 | Eustis et al. | 239/14 |
| 3,774,842 | 11/1973 | Howell | 239/2 S |
| 3,945,567 | 3/1976 | Rambach | 239/14 |
| 3,948,442 | 4/1976 | Dewey | 239/2 S |
| 3,979,061 | 9/1976 | Kircher | 239/2 S |
| 4,004,732 | 1/1977 | Hanson | 239/2 S |
| 4,105,161 | 8/1978 | Kircher et al. | 239/2 S |
| 4,222,519 | 9/1980 | Kircher et al. | 239/14 |
| 4,223,836 | 9/1980 | Eager | 239/2 S |
| 4,352,458 | 10/1982 | Masel | 239/77 |
| 4,493,457 | 1/1985 | Dilworth et al. | 239/2 S |

FOREIGN PATENT DOCUMENTS

| | | | |
|---|---|---|---|
| 2376384 | 7/1978 | France | 239/14 |

*Primary Examiner*—Jeffrey V. Nase
*Assistant Examiner*—James R. Moon, Jr.
*Attorney, Agent, or Firm*—Harness, Dickey & Pierce

[57] ABSTRACT

An improved method of and apparatus for making artificial snow. The snow making machine disclosed for practicing the invention includes a ducted fan within a housing for generating a substantially unidirectional, high volume air current over the area to be deposited with snow. High velocity water sprays are injected into the air current from above and below the air current via a plurality of nozzles connected to an annular water manifold circumferentially disposed around the discharge end of the housing. Nucleated ice crystals are also injected into the air current by a high velocity vapor spray emitted from a pair of seeder nozzles disposed at the center of the housing. The vapor spray is comprised of a mixture of water and compressed air which is vaporized in a venturi-type expansion chamber prior to emission through the seeder nozzles. In accordance with a second embodiment of this invention, a shroud member surrounds the discharge end of the housing such that a secondary airflow is guided between the shroud and housing. The secondary airflow guided by the shroud has been found to permit greater quantities of high quality snow to be made at given atmospheric conditions and further allows snow to be manufactured in warmer conditions as compared to prior art devices.

16 Claims, 7 Drawing Figures

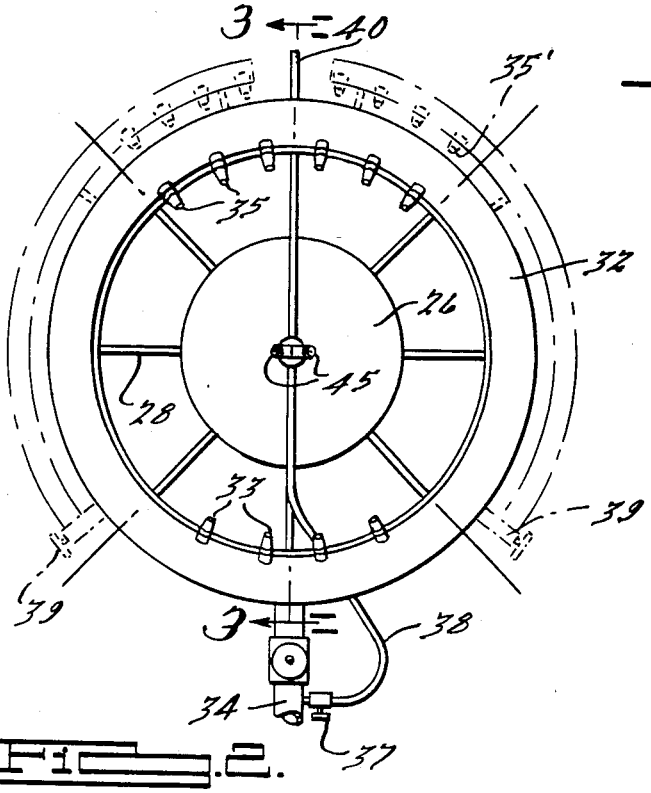
FIG. 2.
FIG. 4.
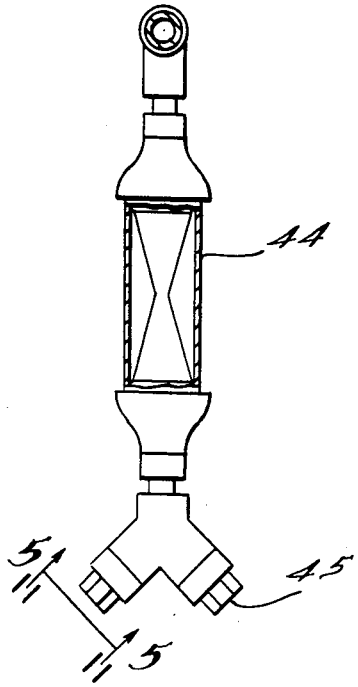
FIG. 5.
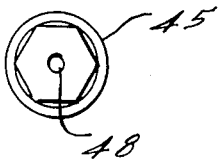
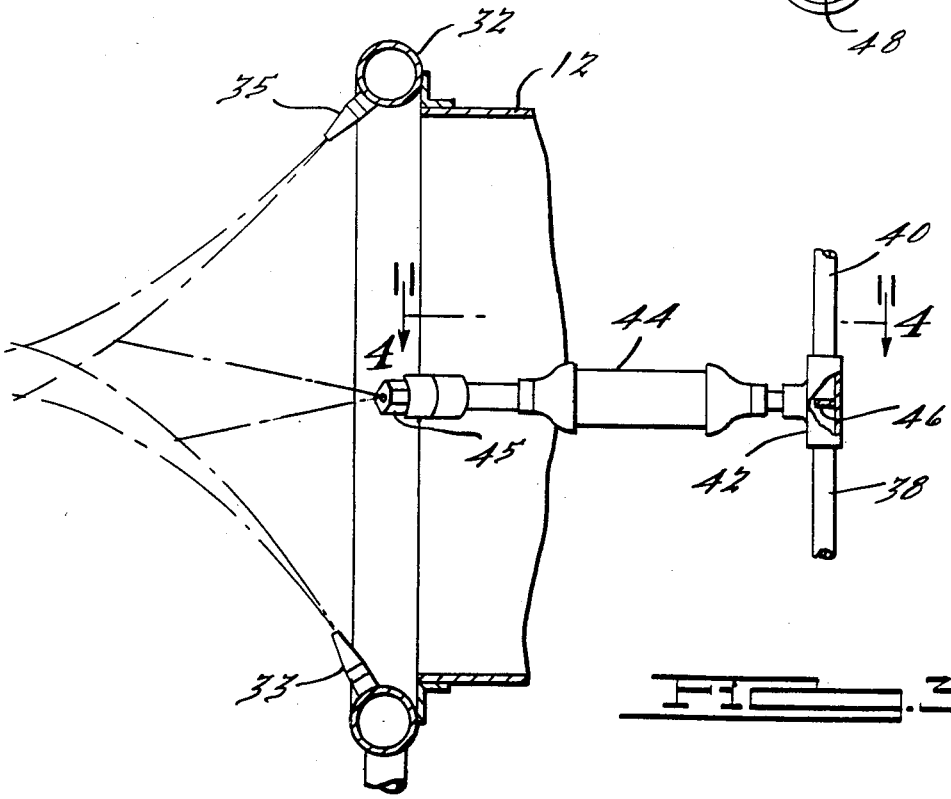
FIG. 3.

METHOD AND APPARATUS FOR MAKING ARTIFICIAL SNOW

CROSS REFERENCE TO RELATED APPLICATIONS

This application is a continuation-in-part of copending U.S. patent application Ser. No. 473,071 filed Apr. 18, 1983, now U.S. Pat. No. 4,493,457.

BACKGROUND AND SUMMARY OF THE INVENTION

The present invention relates to a method and apparatus for making artificial snow and in particular to an improved method and apparatus for making artificial snow which is capable of making large quantities of snow efficiently.

The unpredictability of the weather has made the making of artificial snow an essential aspect of the operation of virtually all successful ski resorts. Commercial snow making machines frequently include a high-powered fan for providing a substantially unidirectional high volume movement of ambient air and means for injecting a water spray into the high volume air current at an appropriate rate sufficient to cause crystallization of the spray and deposition of the crystals as artificial snow. Typically, compressed air and water are added to the water spray to further enhance the crystallization of the water spray.

It is a generally recognized principle that the quantity of snow produced is a direct function of the amount of water used. However, with conventional snow making machines, under given ambient air conditions, only a limited quantity of water may be sprayed into the high volume air movement and still result in high quality snow. If excessive amounts of water are introduced, a less desirable wet snow may result or excess water droplets may begin to fall out of the air stream prior to complete crystallization. Thus, with such machines there exists a significant trade-off between snow quality and quantity which varies in accordance with prevailing atmospheric conditions.

Accordingly, it is the primary object of the present invention to provide an improved apparatus for making artificial snow which increases the quantity of high quality snow which can be produced at given atmospheric conditions.

In addition, it is an object of the present invention to provide an improved snow making machine that is capable of producing high quality snow within a relatively broad range of operating parameters, thereby making effective use of the machine practical.

Furthermore, it is an object of the present invention to provide an improved snow making machine which is more efficient to operate and requires substantially less energy than conventional machines.

In general, the above objects are accomplished by providing a plurality of water nozzles which are disposed in upper and lower quadrants around the periphery of the high volume air stream and a pair of nucleating or seeder nozzles located at the center of the air stream. By injecting the nucleated ice crystals into the voids between the upper and lower quadrants of water spray a substantially longer time is provided for the formation of ice crystals before the nucleated crystals contact the water spray on both sides of the mass. Thus, the effectiveness of the nucleation process is enhanced and the quantity of nuclei available for snow particle formation is increased. Hence, the volume of water which can be used is similarly increased without reducing the quality of the snow produced.

In accordance with a second embodiment of this invention, an enlarged shroud is located at the discharge end of the machine housing. The shroud introduces a secondary airflow which surrounds the airflow discharging from the snow making machine housing. The addition of the shroud has been found to permit greater quantities of high quality snow to be produced in given atmospheric conditions and enables snow production in warmer weather as compared with machines which do not incorporate the shroud.

Additional objects and advantages of the present invention will become apparent from a reading of the detailed description of the preferred embodiment which makes reference to the following set of drawings in which:

BRIEF DESCRIPTION OF THE DRAWINGS

FIG. 2 is an end view of the outlet end of the snow making machine of FIG. 1 taken along line 2—2;

FIG. 3 is a partial sectional view of the snow making machine of FIG. 2 taken along line 3—3;

FIG. 4 is an enlarged sectional view of the seed line taken along line 4—4 in FIG. 3;

FIG. 5 is an enlarged view of a seed nozzle taken along line 5—5 in FIG. 4;

FIG. 6 is a side view partially in longitudinal section of an alternate embodiment according to this invention wherein a shroud assembly is added at the discharge end of the snow making machine housing.

DETAILED DESCRIPTION OF THE PREFERRED EMBODIMENT

Figure 1:
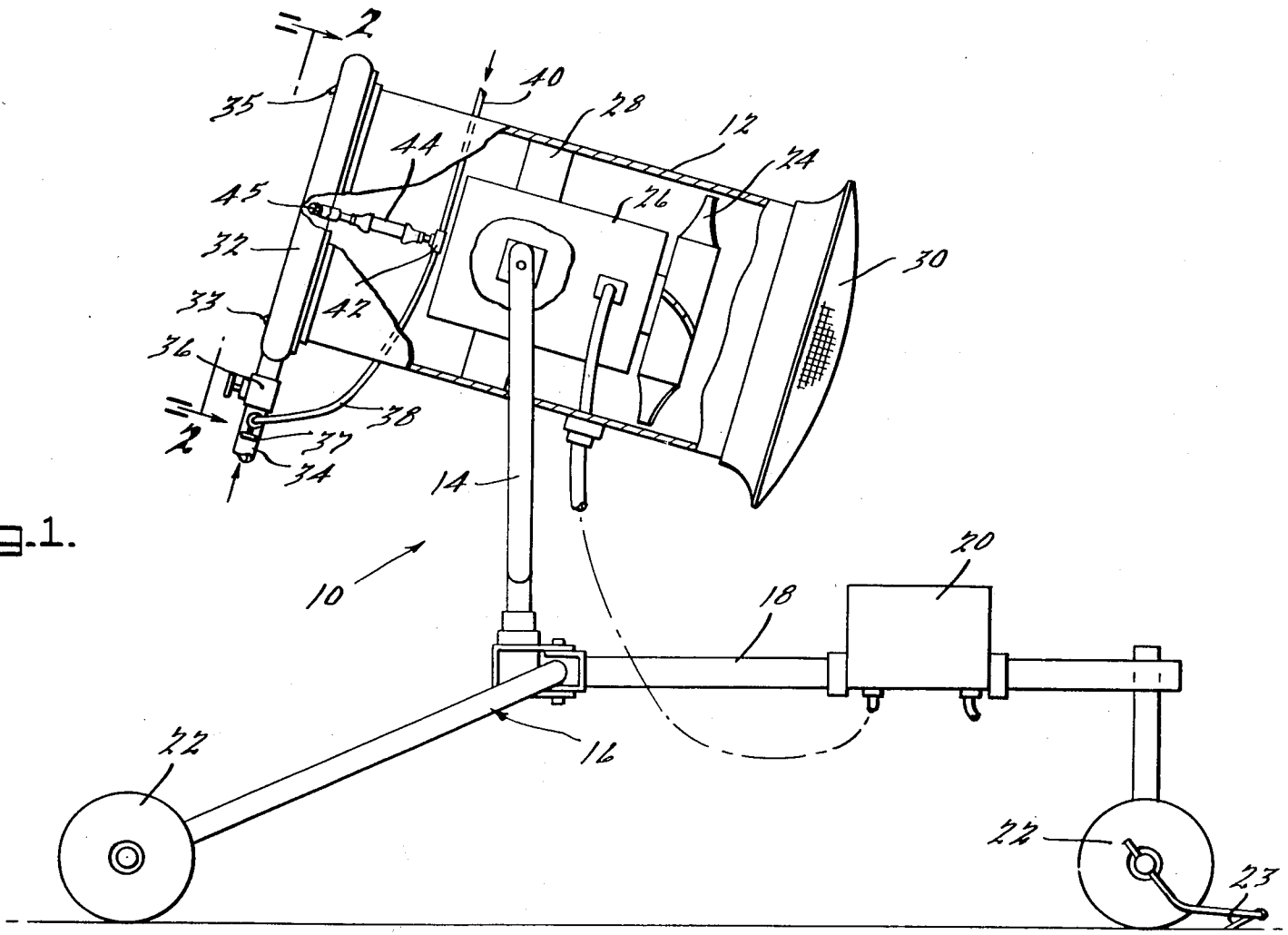
FIG. 1 is a side elevational view in partial cutaway of the snow making machine according to the present invention.

Referring to FIG. 1, a side elevational view of the snow making machine 10 according to the present invention is shown. The snow making machine 10 comprises a cylindrical fan housing 12 mounted to a yoke 14 which is supported on a tripod base 16 such that the fan housing 12 and yoke 14 are rotatable about a vertical axis 360 degrees with respect to the tripod base 16. One leg 18 of the support base 16 extends rearwardly from said vertical axis and has mounted thereto an electronic control box 20, which includes appropriate switches for operating the fan motor. Tripod base assembly 16 is preferably carried by wheels equipped with low pressure, wide tread, "balloon" tires 22 to facilitate transportation of the machine 10. An anchor 23 is preferably connected to the axle of the rear wheel for securing the position of the machine during operation.

The fan housing 12 contains a vane axial blower comprising an impeller fan 24 having a circumferential array of radial blades drivably connected to an electric motor 26. Motor 26 is coaxially mounted within fan housing 12 by a circumferential array of stationary vanes 28 fixed within the housing. The vanes 28 are oriented so that the generally spiral air pattern generated by the fan 24 is converted by the vanes 28 to a substantially linear, unidirectional air current. The rear intake of the housing 12 is preferably covered by a coarse mesh screen 30 to minimize the likelihood of injury to the operator and also to prevent leaves, twigs, and other debris from being drawn into the machine.

Mounted at the outlet end of the machine about the periphery of the fan housing 12 is a circular water manifold 32 having connected thereto groups of water nozzles 33 and 35. As best shown in FIG. 2, the water nozzles are separated into two groups; an upper group 35 and a lower group 33. In the preferred embodiment of the present snow making machine, there are six water nozzles in upper group 35 and four water nozzles in lower group 33. The precise number of water nozzles is not critical to the invention. Significantly, however, it will be noted that both the upper 35 and lower 33 groups of water nozzles are substantially confined to the top and bottom portions of the water manifold 32. More specifically, it will be appreciated that the top group of water nozzles 35 are all located substantially within the upper quadrant of the manifold 32, centered about the vertical axis thereof, and the bottom group of water nozzles 33 are all located substantially within the lower quadrant of the manifold 32, centered about the vertical axis. The quadrants of the water manifold 32 centered about the horizontal axis thereof are substantially devoid of any water nozzles. The water nozzles in upper group 35 are preferably mounted to the water manifold 32 at a 45 degree angle relative to the vertical plane of the manifold and the water nozzles 33 in the lower group are preferably mounted to the water manifold 32 at a 30 degree angle relative to the vertical. The water nozzles utilized in the preferred embodiment of the snow making machine comprise 60 degree full cone, spiral nozzles, manufactured by Bete Fog Nozzle, Inc., No. TF6NN. Accordingly, it will be appreciated that the water spray from the upper set of nozzles 35 is emitted into the high volume current of air from essentially above the air current while the water spray from the lower set of nozzles 33 is emitted into the air current from essentially below the air current.

The water manifold 32 is supplied by a $1\frac{1}{2}$ inch water inlet line 34, with the supply of water to the manifold being controlled by a control valve 36. An additional $\frac{1}{4}$ inch water line 38 is tapped off the main water line 34 upstream from the main control valve 36 and extends through an opening in the bottom of the fan housing 12 to supply the seeder nozzles 45. Water supply through this line 38 is controlled by a second control valve 37. Optionally, a second tier of water nozzles 41', supplied through an additional pair of valves 39 tapped off the water manifold 32, may be included in the upper group as shown in phantom in FIG. 2, to further increase the capacity of the machine 10.

The seeder nozzles 45, as illustrated in FIGS. 1-3, are located essentially at the center of the water manifold ring 32, although set slightly forward of the fan housing 12. In the preferred embodiment, a pair of seeder nozzles 45 are provided with are disposed horizontally and positioned at a ninety degree included angle, as best shown in FIG. 4. The seeder nozzles utilized in the preferred embodiment comprise Bete N.F. nozzles that have been modified by drilling a 0.125 inch round hole 48 into the opening in the face of the nozzle, as shown in FIG. 5. The seeder nozzles 45 are fed by water line 38 and a source of compressed air which is supplied via a one half inch air inlet line 40 that extends through an opening in the top of the fan housing 12.

The compressed air inlet line 40 and the water inlet line 38 are joined at a T-coupling 42 which is located adjacent the rear of the electric motor 26 in the fan housing 12. With particular reference to FIG. 3, T-coupling 42 has formed internally therein a plate 46 which is disposed transversely to the water and air inlet lines, 38 and 40 respectively, to insure that the compressed air and water flow out the center tap of the coupling. The compressed air from line 40 and the water from line 38 are combined and mixed in an expansion chamber 44 which, as shown in FIG. 4, contains a venturi-type constricted middle section which serves to vaporize the air-water mixture. The water vapor is then expelled as a fine mist through the seeder nozzles 45. The ratio of compressed air to water in the seed line in the preferred embodiment varies from approximately 8:1 to 15:1.

In operation, a cold water spray is injected by both upper and lower sets of water nozzles, 35 and 33 respectively, into the high volume air current generated by the fan 24 such that the two sectors of water spray converge downstream from the output end of the machine 10. Simultaneously, a fine vapor mist of nucleated ice crystals is emitted by the twin seeder nozzles 45 to thereby generate a relatively flat fan of nucleation horizontally across the entire high volume air stream so that the nucleated particles contact the two surfaces of water as the sprays from the upper and lower sets of water nozzles 35 and 33 converge. Importantly, the central convergence of the sprays from the upper and lower sets of water nozzles 35 and 33 consolidates the air stream causing the water spray to remain suspended within and carried by the air stream for a substantially greater distance than with prior designs, thereby providing significantly greater time for the process of crystallization to take place. Additionally, it is significant to note that the seeder nozzles 45 emit their nucleated ice crystal spray into the void between the two converging water sprays, thus extending the time before the nucleating ice crystals contact the two separate surfaces of water. This, in turn, significantly increases the effectiveness of the nucleation process, thereby enhancing the capacity of the machine for high quality snow crystal formation. Moreover, the increased efficiency of the nucleation process provides the additional dividend of permitting the use of substantially less compressed air. In particular, the snow making machine of the preferred embodiment utilizes approximately one-half the compressed air volume of conventional snow making machines, thus permitting the use of an air compressor of one-half the horsepower capacity, which, of course, reduces the energy consumption of the machine. Finally, the above-noted features in combination provide the snow making machine of the present invention with the capability of producing greater quantities of high quality snow at higher temperatures under given atmospheric conditions, than with conventional snow making machines.

Figure 7:
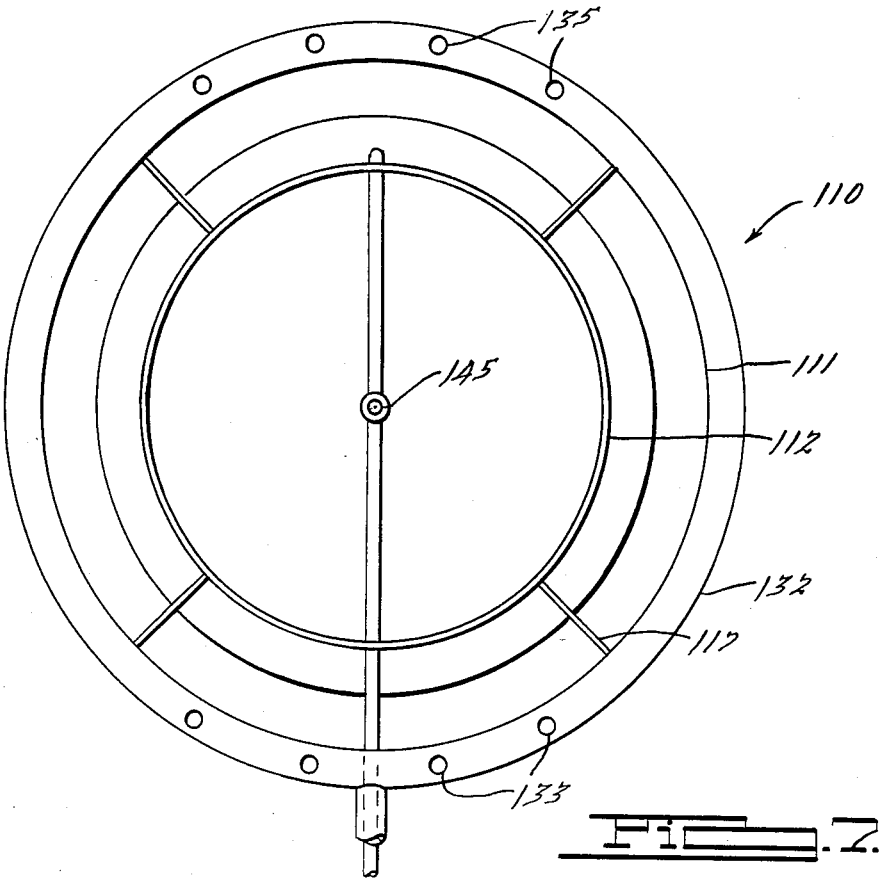
FIG. 7 is a front view of the snow making machine illustrated by FIG. 6.
Figure 8:
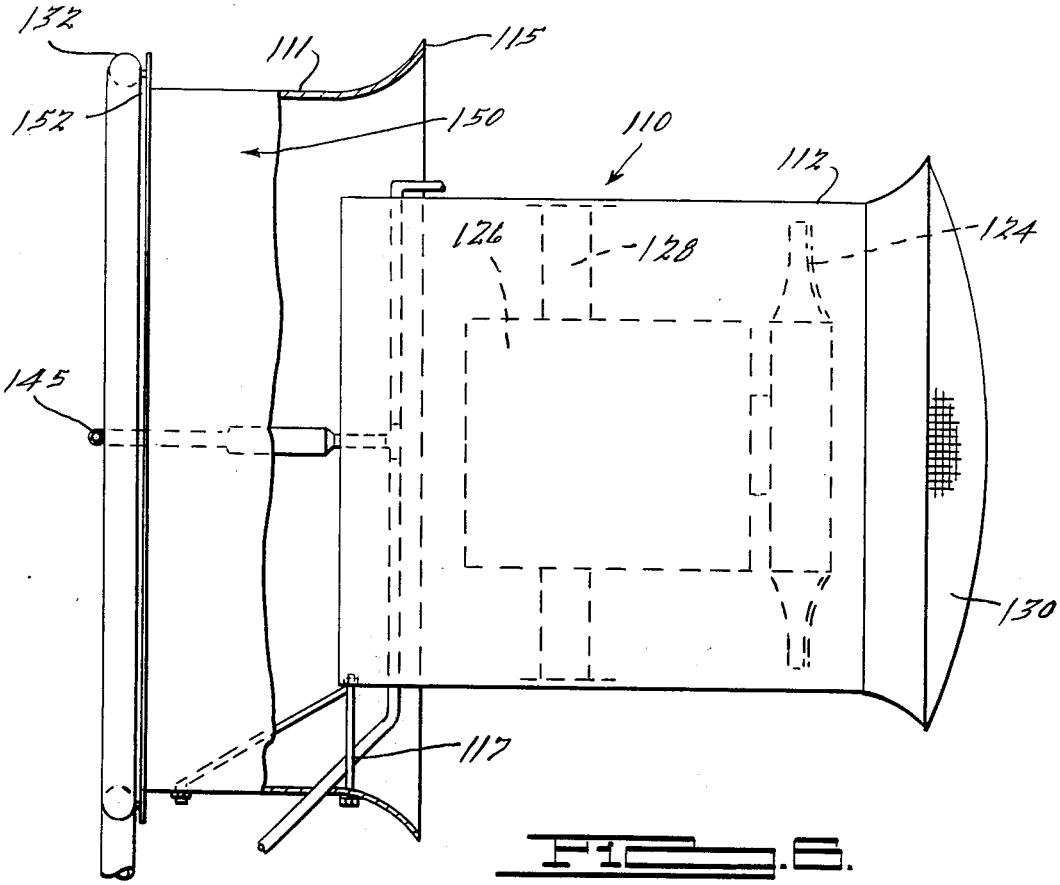

A second embodiment according to this invention is illustrated with reference to FIGS. 6 and 7. These figures illustrate modified snow making machine 110 which differs from the previously described embodiment in that an enlarged diameter shroud member 111 is provided. Fan housing 112 is substantially identical to that described in connection with the first embodiment. Fan housing 112 features an internally mounted impeller fan 124 driven by an electric motor 126. Electric motor 126 is mounted within fan housing 112 by stationary vanes 128. Like the first embodiment, housing 112 includes screen 130 which prevents access to the rotating internal components by operators or debris. Shroud member 111 is generally cylindrical and preferably has a flared entrance end 115 and is mounted by a plurality of radially directed mounting rods 117 which maintain shroud member 111 in coaxial alignment with fan housing 112. Shroud 111 is axially located such that it lies within the plane formed by the discharge end of housing 112. Circular water manifold 132 is mounted at the discharge end of shroud member 111. In addition, seeder nozzles 145 are centrally located generally within the plane of the discharge end of shroud member 111.

This second embodiment of this invention employs shroud member 111 to control the introduction of a secondary airflow, identified by arrow 150, which flows into the annular gap between housing 112 and shroud flared end 115. Due to the high rate at which the primary airflow flows, atmospheric air in the vicinity of this primary airflow is caused to move. Shroud member 111 guides this secondary airflow movement such that it can mix with the primary airflow.

In operation, snow making machine 110 provides increased performance in that greater quantities of high quality snow may be produced within given atmospheric conditions. Additionally, this embodiment permits snow production in warmer atmospheric conditions than is possible using prior art devices. These benefits are believed to result due to several factors. By causing greater quantities of atmospheric air to be mixed within the atomized water being dispersed by nozzles 145, 133 and 135, greater cooling, and therefore ice crystal generation, of the water occurs. Also, the induced secondary airflow is of a cooler temperature and therefore enhances snow production since it is not driven past electric motor 126 which dissipates heat which is added to the airflow. Finally, since water nozzles 133 and 135 are caused to spray across the annular secondary airflow region, it is suspended in air longer and therefore has a greater opportunity to be cooled sufficiently to generate ice crystals.

While the above description constitutes the preferred embodiment of the present invention, it will be appreciated that the invention is susceptible to modification, variation and change without departing from the proper scope or fair meaning of the accompanying claims.

I claim:

1. An apparatus for making snow comprising:

a housing having an inlet end and a discharge end, fan means disposed in said housing for generating a substantially unidirectional high-volume primary airflow stream exiting at said discharge end, a shroud surrounding said housing discharge end, thereby forming an annular gap between said shroud and said housing, said shroud controlling the introduction of a secondary airflow stream through said annular gap which surrounds said primary airflow stream, water injection means located around the periphery of said shroud for injecting water across said secondary airflow stream and into said primary airflow stream; and nucleation means for injecting a high velocity water spray into said primary airflow stream.

2. An apparatus according to claim 1 wherein said shroud is generally cylindrical and has an outwardly radially flared inlet end.

3. An apparatus according to claim 1 wherein said shroud is connected to said housing by a plurality of radially extending mounting rods.

4. An apparatus according to claim 1 wherein said shroud is located within the plane of said housing discharge end.

5. An apparatus for making artificial snow comprising:

a housing having an inlet end and a discharge end;

fan means disposed within said housing for generating a substantially unidirectional high-volume primary airflow stream;

a shroud surrounding said housing discharge end thereby forming an annular gap between said shroud and said housing, said shroud controlling the introduction of a secondary airflow stream through said annular gap which surrounds said primary airflow stream, first water injection means located around the periphery of said shroud for injecting a high-velocity water spray across said secondary airflow stream and into said primary airflow stream at an obtuse angle relative to the direction of said primary airflow stream from a location substantially above said primary airflow stream;

second water injection means located around the periphery of said shroud for injecting a high-velocity water spray across said secondary airflow stream and into said primary airflow stream at an obtuse angle relative to the direction of said primary airflow stream from a location substantially below said primary airflow stream; and nucleation means for injecting a high-velocity spray comprising a mixture of water and compressed air into said primary airflow stream from a location approximately midway between said first and second water injection means.

6. The apparatus of claim 5 wherein said nucleation means includes a pair of seeder nozzles centered approximately between said first and second water injection means.

7. The apparatus of claim 6 wherein said pair of seeder nozzles are disposed in a horizontal plane at approximately a 90 degree included angle centered relative to the direction of said primary airflow stream.

8. The apparatus of claim 5 wherein said nucleation means includes an expansion chamber for mixing said compressed air and water.

9. The apparatus of claim 8 wherein said expansion chamber contains a venturi-type constricted middle section.

10. The apparatus of claim 5 further including an annular-shaped water manifold circumferentially located about said shroud for receiving an external supply of water, and wherein said first water injection means comprises a plurality of water nozzles connected to said water manifold and disposed substantially within the upper quadrant of said manifold centered about the vertical axis thereof and said second water injection means comprises a plurality of water nozzles connected to said water manifold and disposed substantially within the lower quadrant of said manifold centered about the vertical axis thereof.

11. The apparatus of claim 5 wherein said shroud is generally cylindrical and has an outwardly flared inlet end.

12. An apparatus for generating artificial snow comprising in combination:

an axial fan disposed within a cylindrically-shaped housing having an inlet end and a discharge end, for generating a substantially unidirectional high-volume primary airflow stream;

a shroud surrounding said housing discharge end thereby forming an annular gap between said shroud and said housing, said shroud controlling the introduction of a secondary airflow stream through said annular gap which surrounds said primary airflow stream, an annular water manifold circumferentially located about said shroud and having connected thereto an external supply of water;

a first plurality of water nozzles connected to said water manifold substantially within the upper quadrant of said manifold centered about the vertical axis thereof and disposed so as to inject a high-velocity water spray across said secondary airflow stream and into said primary airflow stream at an obtuse angle relative to the direction of said primary airflow stream;

a second plurality of water nozzles connected to said water manifold substantially within the lower quadrant of said manifold centered about the vertical axis thereof and disposed so as to inject a high-velocity water spray across said secondary airflow stream and into said primary airflow stream at an obtuse angle relative to the direction of said primary airflow stream;

at least one seeder nozzle for injecting a high-velocity spray into said primary airflow stream from a location at approximately the center of said housing, said seeder nozzle being supplied by a mixture of water and compressed air supplied through a venturi-type expansion chamber connected to said seeder nozzle.

13. The apparatus of claim 12 further including a pair of seeder nozzles disposed in a horizontal plane and positioned at a 90 degree included angle centered relative to the direction of said primary airflow stream.

14. An apparatus according to claim 12 wherein said shroud is generally cylindrical and has an outwardly radially flared inlet end.

15. An apparatus according to claim 12 wherein said shroud is located within the plane of said housing discharge end.

16. A mwethod of making artificial snow including the steps of:

generating a substantially unidirectional high-volume primary airflow stream;

generating and controlling a secondary airflow stream surrounding said primary airflow stream;

injecting a high-velocity water spray across said secondary airflow stream and into said primary airflow stream from a location substantially above said primary airflow stream; and injecting a high-velocity water spray across said secondary airflow stream and into said primary airflow stream from a location substantially below said primary airflow stream; and injecting into said primary airflow stream a high-velocity spray comprising a mixture of water and compressed air from a location approximately in the center of said primary airflow stream.

* * * * *